US011309145B2

(12) United States Patent
Chin

(10) Patent No.: US 11,309,145 B2
(45) Date of Patent: Apr. 19, 2022

(54) SWITCH DEVICE FOR REGULATING MOVEMENT OF OPERATION MEMBER

(71) Applicant: TOYO DENSO KABUSHIKI KAISHA, Minato-ku (JP)

(72) Inventor: Eikichi Chin, Tsurugashima (JP)

(73) Assignee: TOYO DENSO KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/725,281

(22) Filed: Dec. 23, 2019

(65) Prior Publication Data

US 2020/0286697 A1 Sep. 10, 2020

(30) Foreign Application Priority Data

Mar. 7, 2019 (JP) ..... JP2019-041775

(51) Int. Cl.

| | |
|---|---|
| ***H01H 13/14*** | (2006.01) |
| ***H01H 13/52*** | (2006.01) |
| ***G05G 1/08*** | (2006.01) |
| ***H01H 13/20*** | (2006.01) |

(52) U.S. Cl.

CPC ..... *H01H 13/52* (2013.01); *G05G 1/08* (2013.01); *H01H 13/14* (2013.01); *H01H 13/20* (2013.01)

(58) Field of Classification Search

CPC ..... H01H 13/52; H01H 13/20; H01H 13/14; H01H 23/02; H01H 23/12; H01H 23/145; H01H 2011/0043; H01H 23/143; H01H 23/16; H01H 23/08; H01H 23/24; H01H 23/003; H01H 23/04; H01H 23/162; H01H 23/30; G05G 1/08

See application file for complete search history.

(56) References Cited

U.S. PATENT DOCUMENTS 4,851,625 A * 7/1989 Liebich ..... H01H 15/005 200/551
6,333,479 B1 * 12/2001 Tai ..... H01H 15/005 200/16 D

FOREIGN PATENT DOCUMENTS

| | | |
|---|---|---|
| JP | S51-093969 | 7/1976 |
| JP | S63-118129 | 7/1988 |
| JP | S63-118129 | 7/1998 |

* cited by examiner

*Primary Examiner* — Ahmed M Saeed
(74) *Attorney, Agent, or Firm* — Cozen O'Connor

(57) ABSTRACT

A switch device reduces an impact sound generated when the operation member returns to its original position. The switch device includes a housing member, an operation knob accommodated in the housing member and capable of being pushed, and a spring that urges the operation knob in a direction opposite to the pushing direction. The housing member includes a two-pronged stopper that regulates the movement of the operation knob in the opposite direction. The operation knob includes a tab that abuts on the two-pronged stopper. When the movement of the operation knob in the opposite direction is regulated, the two-pronged stopper and the tab make a line contact first.

5 Claims, 6 Drawing Sheets

SWITCH DEVICE FOR REGULATING MOVEMENT OF OPERATION MEMBER

BACKGROUND OF THE INVENTION

Field of the Invention

The present invention relates to a switch device that regulates movement of an operation member.

Description of the Related Art

In recent years, push-button-type switch devices have been used to start and stop automobile engines. A switch device includes a housing member in which an operation member is accommodated, and a driver pushes the operation member to start or stop the engine. When the driver releases his/her finger from the operation member, the pushing force acting on the operation member is released, and a restoring force is applied to the operation member to return the operation member to the original position.

As a related technique, a push button switch has been proposed, in which a flexible protrusion is integrally formed on the surface of a plunger which faces a base stopper, and a flexible means is provided to bend the flexible protrusion while the plunger is pushed (see Japanese Laid-open Utility Model Publication (Kokai) No. S63-118129). Also, a silencer structure for a push button switch has been proposed, in which an elastic piece is integrally provided on a slider and an abutting portion is integrally provided on a casing. The elastic piece abuts on the abutting portion and bends (see Japanese Laid-open Utility Model Publication (Kokai) No. S51-93969).

Usually, the switch device includes an urging member having elasticity, and when the pushing force to the operation member is released from the switch device, the operation member returns to its original position by an urging force of the urging member. If a regulating member is provided for stopping the operation member at a predetermined position during the return of the operation member to the original position, the operation member receives the urging force and vigorously comes into contact with the regulating member. At this time, a large impact sound is generated if a large contact area is provided between the operation member and the regulating member.

The push button switches described in Japanese Laid-open Utility Model Publications (Kokai) No. S63-118129 and No. S51-93969 are the switches that mute sound generated when the switch is pushed. These switches do not mute the impact sound generated when the operation member returns to the original position after the pushing force of the switch device on the operation member is released. For example, the technique of Japanese Laid-open Utility Model Publication (Kokai) No. S63-118129 applies an urging force by a return spring in a direction opposite to the pushing direction when the plunger main body returns to the original position. At this time, a larger impact sound is generated when the plunger main body returns to the original position.

Similarly, with the technique disclosed in Japanese Laid-open Utility Model Publication (Kokai) No. S51-93969, a larger impact sound is generated when the slider returns to the original position by the urging force of the coil spring. When the switch is operated, the operation member is pushed in against an elastic force of, for example, the return spring or the coil spring. Therefore, it is expected that a larger impact sound is generated when the operation member returns to the original position compared with the impact sound generated when the switch is operated.

SUMMARY OF THE INVENTION

The present invention provides a switch device that reduces an impact sound generated when an operation member returns to its original position.

Accordingly, an aspect of the present invention provides a switch device including a housing member, an operation member accommodated in the housing member and capable of being pushed, and an urging member that urges the operation member in a direction opposite to a pushing direction, in which the housing member includes a regulating portion that regulates movement of the operation member in the opposite direction, the operation member includes a portion to be regulated that abuts on the regulating portion, and when the movement of the operation member in the opposite direction is regulated, the regulating portion and the portion to be regulated make a line contact with each other first.

According to the present invention, the impact sound generated when the operation member of the switch device returns to its original position can be reduced.

Further features of the present invention will become apparent from the following description of exemplary embodiments (with reference to the attached drawings).

BRIEF DESCRIPTION OF THE DRAWINGS

FIG. 2 is a schematic side view of the switch device in a state where an operation knob is pushed in.

DESCRIPTION OF THE EMBODIMENTS

Hereinafter, an embodiment will be described with reference to the accompanying drawings. It should be noted that the scope of the present invention is not limited to the configurations described in the following embodiment. Hereinafter, the switch device is described as a switch for starting and stopping an automobile engine. However, the switch device to which the present embodiment is applied is not limited to the switch for starting and stopping an automobile engine.

Figure 1:
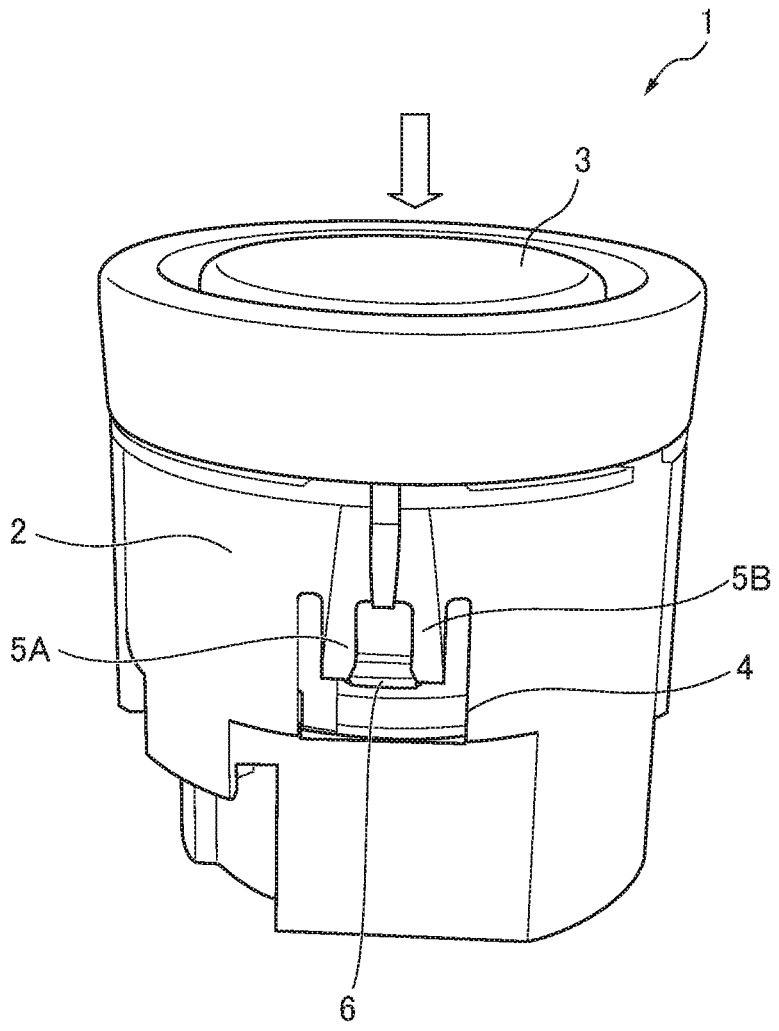
FIG. 1 is an external view showing an example of a switch device.

FIG. 1 is an external view showing an example of a switch device 1 according to the present embodiment. The switch device 1 includes a housing member 2 and an operation knob 3. The operation knob 3 is accommodated in the housing member 2 and acts as an operation member that can be pushed in a direction of an arrow in FIG. 1. When a pushing operation is performed on the operation knob 3, the operation knob 3 is pushed in the direction of the arrow in FIG. 1, and the function of the switch device 1 is turned on. As described above, in the case where the switch device 1 is the switch for starting and stopping the automobile engine, the engine is started or stopped by the driver by pushing the operation knob 3.

The housing member 2 in FIG. 1 has a substantially cylindrical shape, and an opening 4 is formed in a portion of the outer peripheral surface of the housing member 2. It should be noted that the shape of the housing member 2 is not limited to the substantially cylindrical shape, and may be shaped like a prism. A two-pronged stopper 5A, 5B is formed at a portion of the housing member 2 corresponding to the opening 4. In addition, a tab 6 protruding outward is formed at a portion corresponding to the opening 4 on the outer peripheral surface of the operation knob 3 that is accommodated in the housing member 2. The two-pronged stopper 5A, 5B is an example of a regulating portion. The tab 6 is an example of a portion to be regulated. The housing member 2 in which the opening 4 and the two-pronged stopper 5A, 5B are formed is made, for example, by integral molding of resin. Further, the operation knob 3 on which the tab 6 is formed is also formed, for example, by integral molding of resin.

FIG. 1 shows a state where the operation knob 3 is not pushed in yet. For example, the driver of an automobile starts the engine by a pushing the operation knob 3 of the switch device 1 with his/her finger. By this operation, the operation knob 3 is pushed in a direction of the arrow in FIG. 1. When the driver releases his/her finger from the operation knob 3, the operation knob 3 is urged in a direction opposite to the direction of the arrow (pushing direction) in FIG. 1 by the action of a spring 7 which is described later. The operation knob 3 needs to stop its movement at a predetermined position (original position). For this purpose, the two-pronged stopper 5A, 5B is formed on the housing member 2, and a tab 6 is formed on the outer peripheral surface of the operation knob 3. The two-pronged stopper 5A, 5B abuts on the tab 6 to regulate the movement of the operation knob 3 in the opposite direction.

Figure 2:
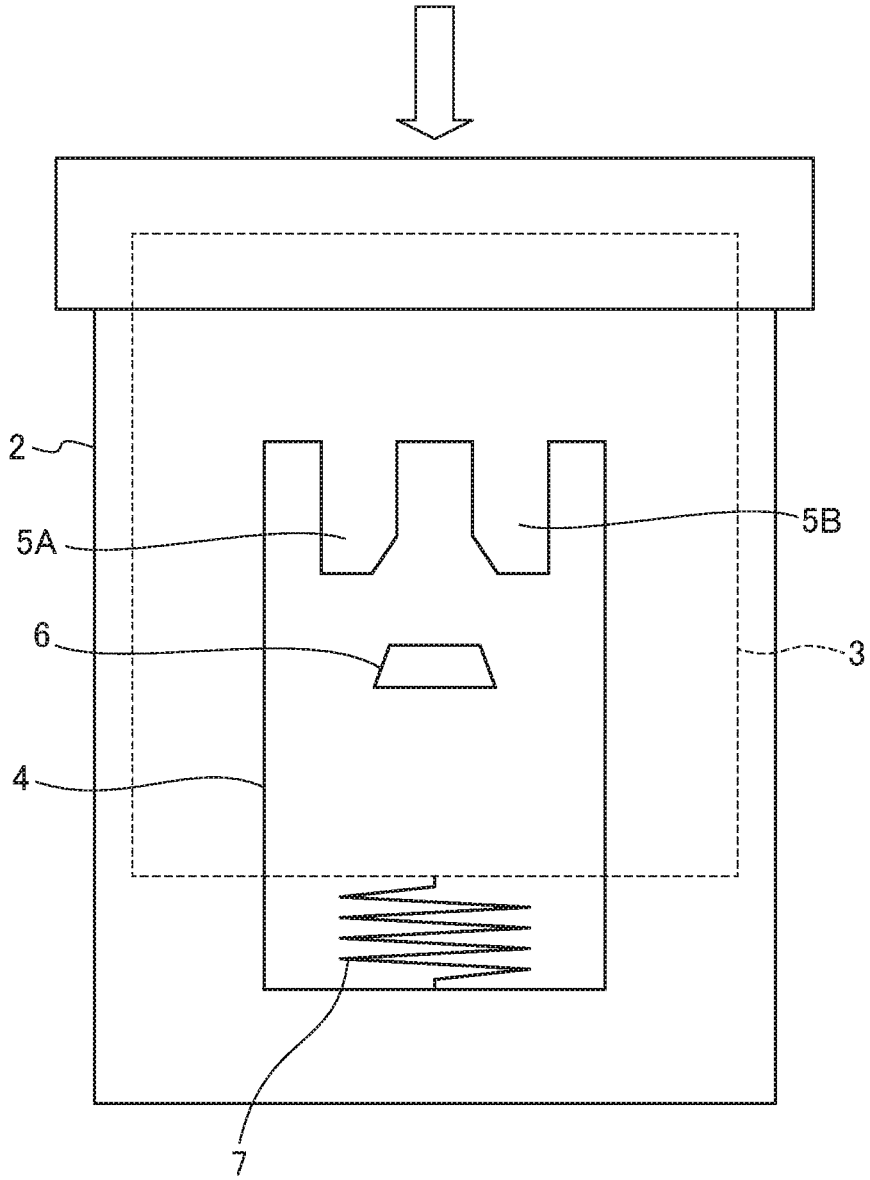

FIG. 2 is a schematic side view of the switch device 1 in a state where the operation knob 3 is pushed in. The spring 7 is attached to the surface (bottom surface) of the operation knob 3 opposite to the surface to be pushed. The present embodiment shows an example in which the spring 7 is applied as an urging member that applies an urging force to the operation knob 3, but any member (elastic member) that applies the urging force to the operation knob 3 in a direction opposite to the pressing direction may be used. For example, a rubber contact or the like having elasticity may be used instead of the spring 7 as the urging member.

FIG. 2 shows a state where the operation knob 3 is pushed in by the finger of the driver. Thus, the spring 7 is in a compressed state. When the driver releases his/her finger from the operation knob 3, the pushing force acting on the operation knob 3 is released. When the pushing force is released, the operation knob 3 is urged in the direction opposite to the direction of the arrow in FIG. 2 by the urging force (restoring force) of the spring 7. The urging force of the spring 7 causes the operation knob 3 to move in the direction opposite to the direction of the arrow in FIG. 2. Then, the movement of the operation knob 3 is regulated at a pre-pushing position (original position).

Figure 3:
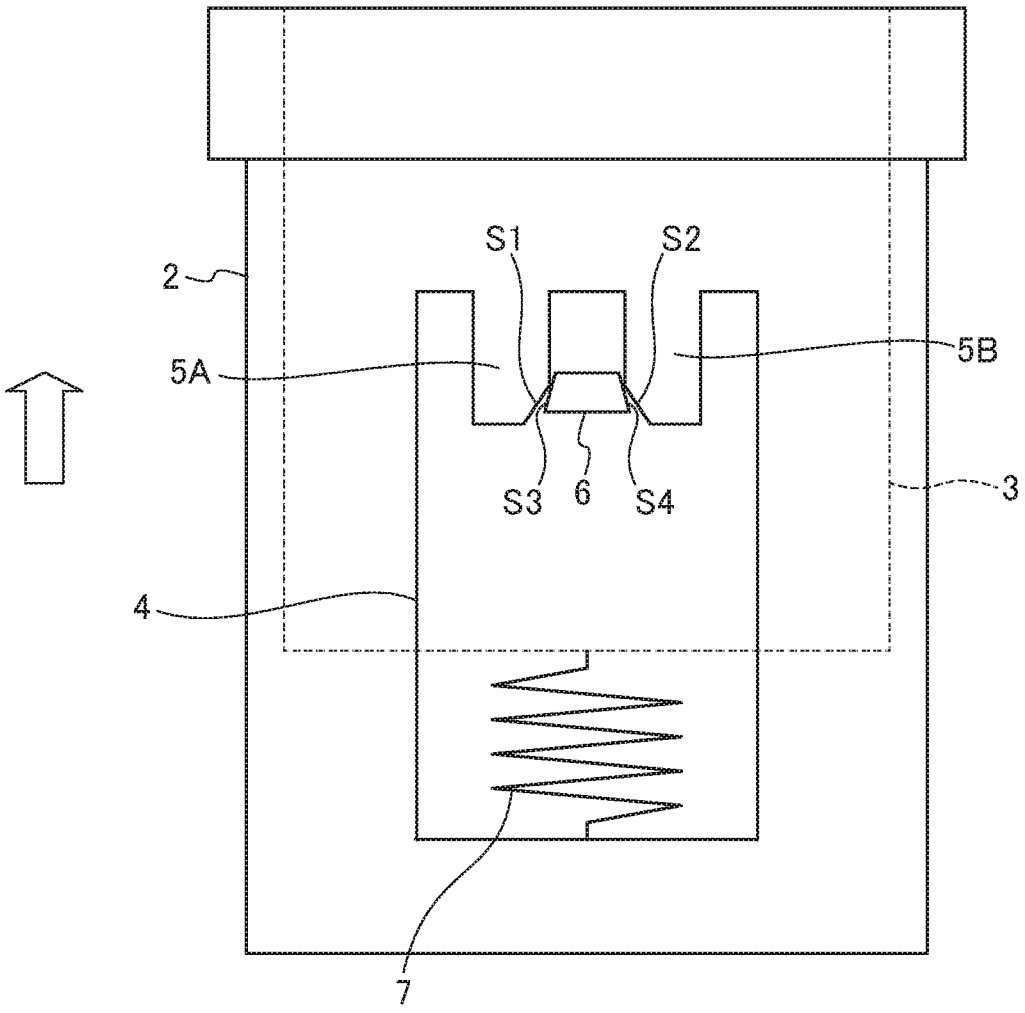
FIG. 3 is a schematic side view of the switch device in a state where the movement of the operation knob is regulated.

FIG. 3 is a schematic side view of the switch device 1 in a state where the movement of the operation knob 3 is regulated. FIG. 3 shows a state where the operation knob 3 is returned to its original position, and the pushing surface of the operation knob 3 is in such a positional relationship as forming a substantially identical plane with the surface of the housing member 2. As described above, the tab 6 is formed on the operation knob 3. Therefore, the tab 6 moves along with the operation knob 3 in the direction of the arrow in FIG. 3 (or the direction opposite to the pushing direction). The tab 6 is a protrusion protruding outward from the operation knob 3 and abuts on the two-pronged stopper 5A, 5B formed on the housing member 2. The two-pronged stopper 5A, 5B functions as a receiving portion for receiving the tab 6, and the movement of the operation knob 3 is regulated when the tab 6 abuts on the two-pronged stopper 5A, 5B.

Of two prongs of the two-pronged stopper 5A, 5B, a slope S1 is formed on the prong 5A at a portion abutting on the tab 6. Of the two prongs of the two-pronged stopper 5A, 5B, a slope S2 is formed on the prong 5B at a portion abutting on the tab 6. The slopes S1 and S2 are examples of a first slope. On the other hand, slopes S3 and S4 are formed on the tab 6 at portions abutting on the two prongs of the two-pronged stopper 5A, 5B. The slopes S3 and S4 are examples of a second slope. The slopes S1 and S2 are slopes that expand symmetrically in a direction in which the operation knob 3 is pushed, and when assuming the direction in which the operation knob 3 is pushed as a standard direction, are tilted at the same angle regarding the standard direction. The slopes S3 and S4 formed on the tab 6 narrow symmetrically in a direction opposite to the standard direction, and are tilted at the same angle regarding the standard direction. In the present embodiment, the tilt angle of the slopes S1 and S2 is different from the tilt angle of the slopes S3 and S4 regarding the standard direction. Therefore, when the movement of the operation knob 3 is regulated, the two-pronged stopper 5A, 5B and the tab 6 make a line contact first. In the example of FIG. 3, the tab 6 makes a line contact at a start point (point where the slopes S1 and S2 are closest to each other) of the slopes S1 and S2 first. It should be noted that, of the slopes S3 and S4 of the tab 6, portions closest to the slopes S1 and S2 may respectively make the line contact with the slopes S1 and S2 first.

As described above, when the pushing force on the operation knob 3 is released, the operation knob 3 is accelerated by the urging force of the spring 7. The tab 6 formed on the accelerated operation knob 3 abuts on the two-pronged stopper 5A, 5B. If the movement of the operation knob 3 is regulated by a surface contact between the operation knob 3 and the housing member 2, and when the operation knob 3 make a surface contact vigorously with the housing member 2, the surfaces collide with each other and a large impact sound is generated. On the other hand, the present embodiment regulates the movement of the operation knob 3 by the two-pronged stopper 5A, 5B by making the line contact with the tab 6 first. Even when the tab 6 vigorously comes into contact with the two-pronged stopper 5A, 5B, the generated impact sound can be reduced compared to a case where the movement of the operation knob 3 is regulated by the surface contact.

Further, the two-pronged stopper 5A, 5B and the tab 6 make the line contact with each other at the slopes formed on the two-pronged stopper 5A, 5B and the slopes formed on the tab 6. Since the two-pronged stopper 5A, 5B and the tab 6, which make the line contact, are slopes, the force acting on the line contact portions can be alleviated when the movement of the operation knob 3 is regulated. For example, if the portions of the two-pronged stopper 5A, 5B that make the line contact with the tab 6 are at right angle, these portions of the two-pronged stopper 5A, 5B receive a large force when the portions make the line contact with the tab 6. This increases damage of the portions where the two-pronged stopper 5A, 5B make the line contact with the tab 6 and causes scratching or wearing at the line contact portions. In contrast, the present embodiment can reduce the damage, because the first and second slopes are both slopes, so that the force acting on the line contact portions can be alleviated.

In the present embodiment, the tilt angles of the slopes S1 and S2 formed on the two-pronged stopper 5A, 5B are gentler than the tilt angles of the slopes S3 and S4 formed on the tab 6. Angles of the slopes S1 and S2 with respect to the direction in which the operation knob 3 is pushed (tilt angles of the slopes S1 and S2) are larger than the angles of the slopes S3 and S4 with respect to the direction in which the operation knob 3 is pushed (tilt angles of the slopes S3, S4). If the tilt angles of the slopes S1, S2 formed on the two-pronged stopper 5A, 5B are steep, the damage of the line contact portions of the two-pronged stopper 5A, 5B increases when the two-pronged stopper 5A, 5B receives the tab 6. The present embodiment can reduce the damage because the tilt angles of the slopes S1, S2 formed on the two-pronged stopper 5A, 5B are gentler than the tilt angles of the slopes S3, S4 formed on the tab 6.

Figure 4:
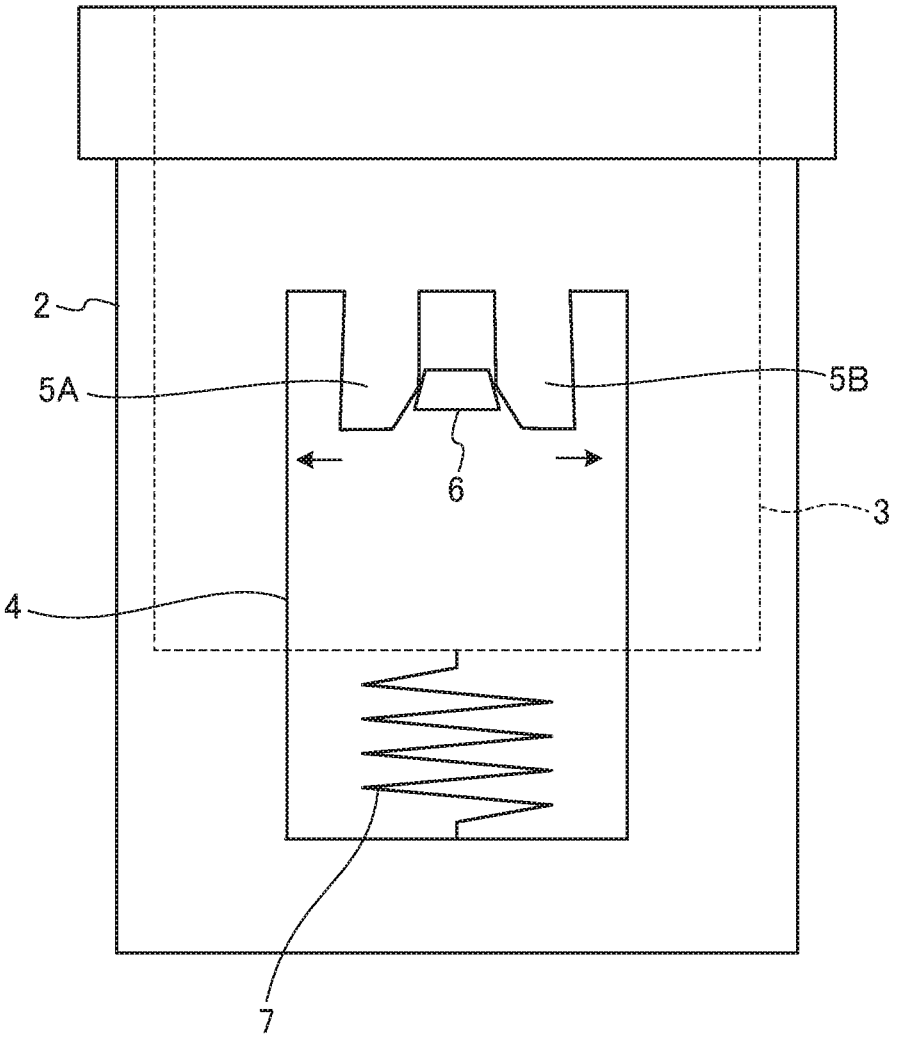
FIG. 4 is a schematic side view of the switch device in a state where the two-pronged stopper is bent in a direction that two prongs move away from each other.

As described above, the movement of the operation knob 3 is regulated when the tab 6 abuts on the two-pronged stopper 5A, 5B which serves as the receiving portion. In the present embodiment, the two-pronged stopper 5A, 5B has a higher flexibility than the tab 6. When the movement of the operation knob 3 is regulated, the tab 6 abuts on the two-pronged stopper 5A, 5B. At this time, as shown in FIG. 4, the two-pronged stopper 5A, 5B bends in a direction that the two prongs move away from each other. This is because the slopes are formed on the two-pronged stopper 5A, 5B and the tab 6, and the two-pronged stopper 5A, 5B is more flexible than the tab 6. By receiving the tab 6 by the two-pronged stopper 5A, 5B in a bending manner, the tab 6 is sandwiched between the two prongs of the two-pronged stopper 5A, 5B.

The two-pronged stopper 5A, 5B bends by the tab 6 when the movement of the operation knob 3 is regulated, thus absorbing the impact of abutting when the tab 6 abuts on the two-pronged stopper 5A, 5B. Therefore, it is possible to further reduce the impact sound when the tab 6 abuts on the two-pronged stopper 5A, 5B. It should be noted that the flexibility of the two-pronged stopper 5A, 5B is preferably higher than that of the tab 6, but may be substantially equal to or lower than the flexibility of the tab 6. In this case, the two-pronged stopper 5A, 5B which is made of resin also bends to some extent when abutting on the tab 6, so that the impact sound may be reduced to some extent.

As described above, the tilt angles of the slopes S1 and S2 formed on the two-pronged stopper 5A, 5B are gentler than the tilt angles of the slopes S3 and S4 formed on the tab 6. In other words, the tilt angles of the slopes S3 and S4 formed on the tab 6 are steeper than the tilt angles of the slopes S1 and S2 formed on the two-pronged stopper 5A, 5B. Therefore, the tab 6 having the slopes both having a steep tilt angle and a low flexibility abuts on the two-pronged stopper 5A, 5B having the slopes of a gentle tilt angle and a high flexibility. As a result, the tab 6 can largely bend the two-pronged stopper 5A, 5B and reduce the impact sound.

As described above, when the tab 6 abuts on the two-pronged stopper 5A, 5B, both prongs of the two-pronged stopper 5A, 5B bend. The two-pronged stopper 5A, 5B bends instantaneously, and then immediately return to the original state (unbent state). As a result, the two-pronged stopper 5A, 5B can immediately regain its original function as the regulating portion.

As described above, when the operation knob 3 returns to the original position by the urging force of the spring 7, the movement of the operation knob 3 is regulated by the two-pronged stopper 5A, 5B that makes the line contact with the tab 6 first. This allows reduction of the impact sound generated when the movement of the operation knob 3 is regulated.

Figure 5:
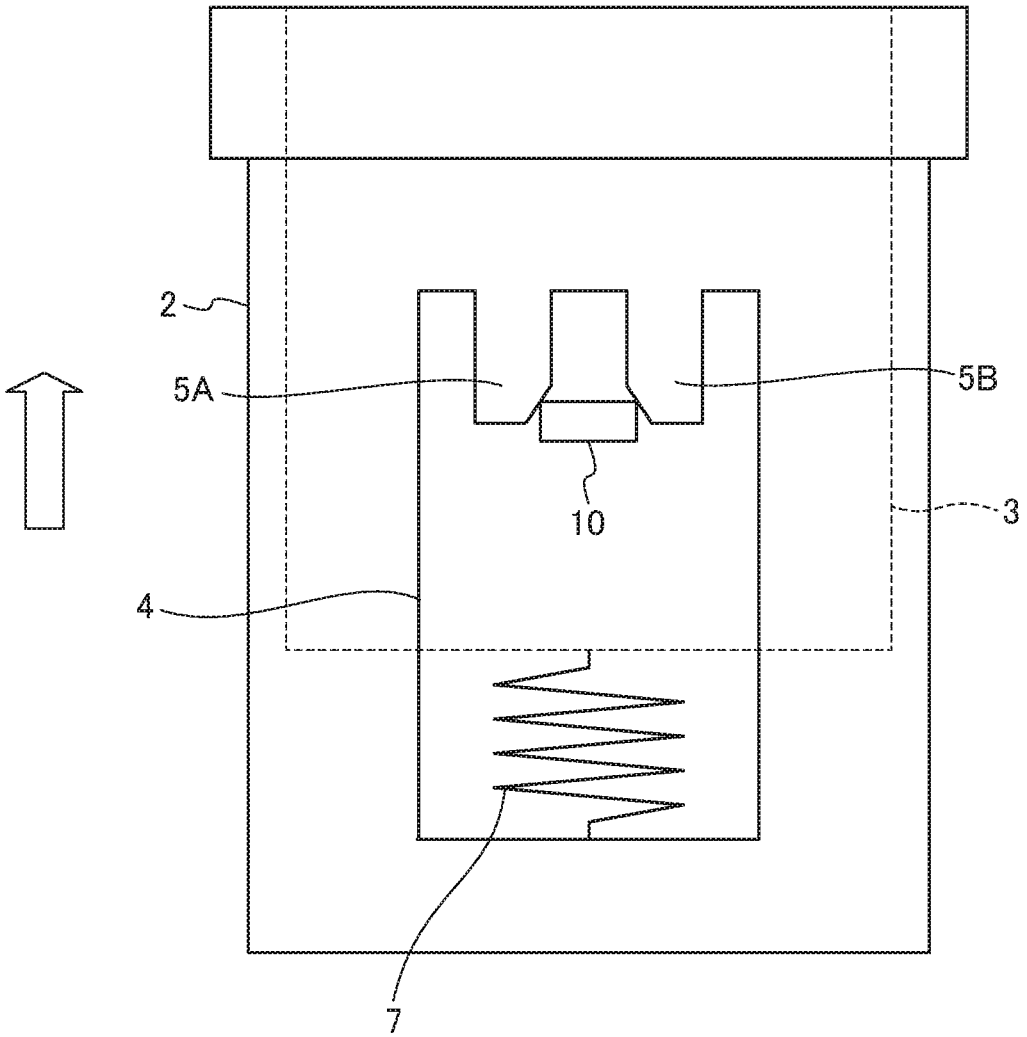
FIG. 5 is a schematic side view of a switch device of a first variation.

In the example described above, the slopes are formed on both prongs of the two-pronged stopper 5A, 5B and the tab 6, but the slopes may not be formed on either one of the two prongs of the two-pronged stopper 5A, 5B and the tab 6. For example, FIG. 5 is a schematic side view of a switch device 1 according to a first variation of the present embodiment. In the example of FIG. 5, no slopes are formed on the tab 10. In this case, when the movement of the operation knob 3 is regulated, the two-pronged stopper 5A, 5B also makes the line contact with the tab 10 first, so the impact sound generated during regulating the movement of the operation knob 3 can be reduced. However, from the viewpoint of the damage described above, it is preferable that the slopes are formed on both the two-pronged stopper 5A, 5B and the tab 6. Further, curved surfaces may be formed at the portions where the slopes are formed on the two-pronged stopper 5A, 5B. A curved surface may also be formed at the portion where the slope is formed on the tab 6.

Figure 6:
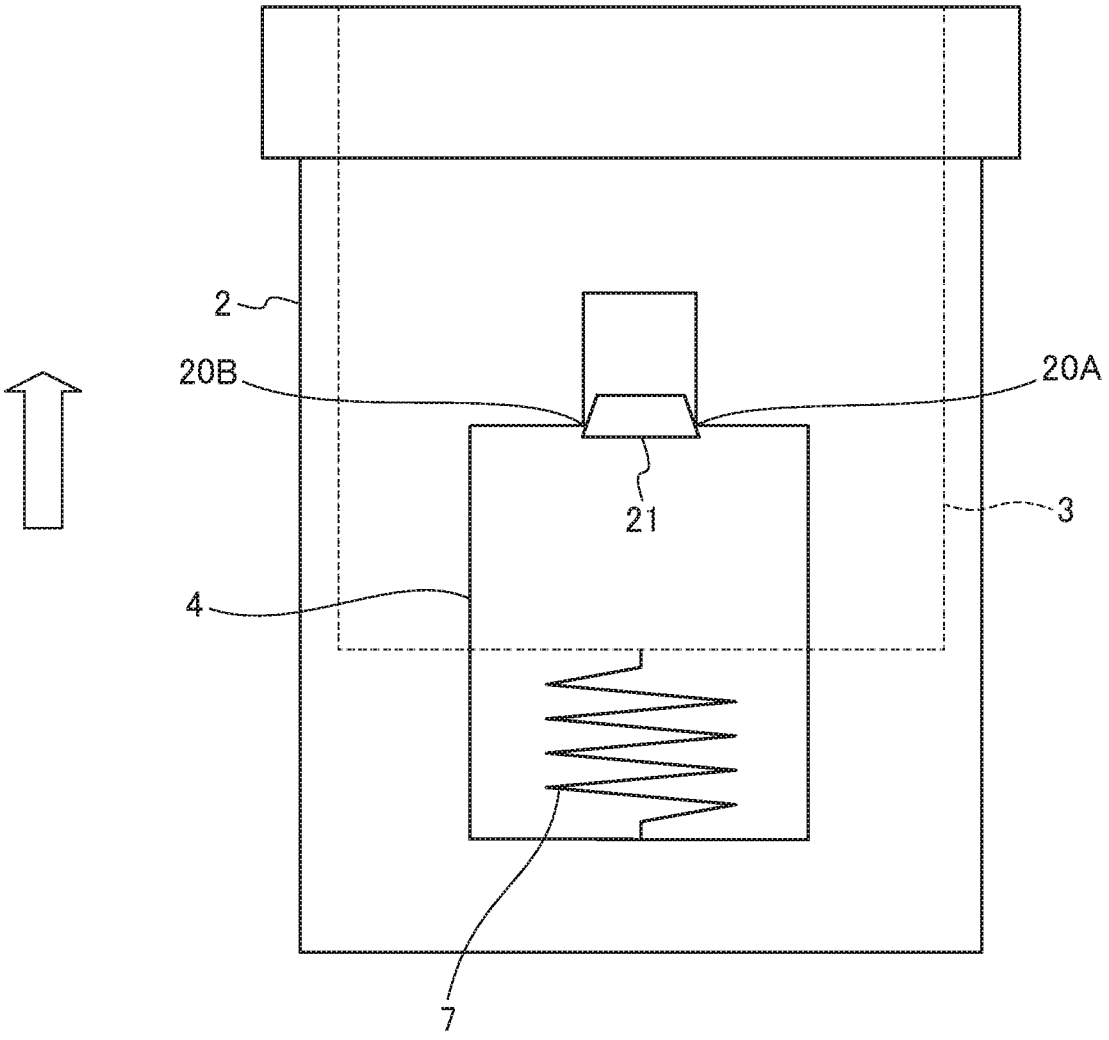
FIG. 6 is a schematic side view of a switch device of a second variation.

Meanwhile, the two-pronged stopper 5A, 5B may not be formed on the housing member 2. For example, FIG. 6 is a schematic side view of a switch device 1 according to a second variation of the present embodiment. In the example of FIG. 6, stepped portions 20A and 20B are formed on the housing member 2, and a tab 21 abuts on the stepped portions 20A and 20B each having right angle. In this case, the stepped portions 20A and 20B function as regulating portions. In this case, when the movement of the operation knob 3 is regulated, the stepped portions 20A and 20B also make the line contact with the tab 21 first. However, from the viewpoint of the damage described above, it is preferable that the two-pronged stopper 5A, 5B is formed on the housing member 2, and the slopes are formed on both the two-pronged stopper 5A, 5B and the tab 6.

This application claims the benefit of Japanese Patent Application No. 2019-041775 filed on Mar. 7, 2019 which is hereby incorporated by reference herein in its entirety.

What is claimed is:

1. A switch device comprising:

a housing member;

an operation member accommodated in the housing member and capable of being pushed; and an urging member that urges the operation member in a direction opposite to a pushing direction, wherein:

the housing member includes a regulating portion that regulates movement of the operation member in the opposite direction, the operation member includes a portion to be regulated that abuts on the regulating portion, the regulating portion and the portion to be regulated are once apart from each other before the portion to be regulated abuts on the regulating portion, when the movement of the operation member in the opposite direction is regulated, the regulating portion and the portion to be regulated make a line contact with each other first, the regulating portion is formed by a two-pronged receiving portion extending in the pushing direction, the portion to be regulated is formed by a protrusion protruding from the operation member, the movement of the operation member is regulated in a state where the protrusion abuts on the receiving portion, when assuming the pushing direction as a standard direction, a tilt angle regarding the standard direction of a first slope formed at a portion of the receiving portion abutting on the protrusion is different from a tilt angle regarding the standard direction of a second slope formed at a portion of the protrusion abutting on the receiving portion, and the tilt angle of the first slope is gentler than the tilt angle of the second slope.

2. The switch device according to claim 1, wherein the receiving portion has a higher flexibility than the protrusion.

3. The switch device according to claim 1, wherein the receiving portion is formed at an opening formed on a side surface of the housing member, and the protrusion protrudes from an outer peripheral surface of the operation member toward the opening.

4. The switch device according to claim 1, wherein after the housing member and the portion to be regulated are apart from one another, the portion to be regulated abuts on the regulating portion due to an urging force of the urging member.

5. The switch device according to claim 1, wherein the urging direction is opposite to the pushing direction.

* * * * *